US012635812B2

(12) United States Patent
Zhong

(10) Patent No.: US 12,635,812 B2
(45) Date of Patent: May 26, 2026

(54) CHILD BASSINET

(71) Applicant: WONDERLAND SWITZERLAND AG, Steinhausen (CH)

(72) Inventor: Zhiren Zhong, Dongguan (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 244 days.

(21) Appl. No.: 18/246,974

(22) PCT Filed: Sep. 29, 2021

(86) PCT No.: PCT/EP2021/076779
§ 371 (c)(1),
(2) Date: Mar. 28, 2023

(87) PCT Pub. No.: WO2022/069535
PCT Pub. Date: Apr. 7, 2022

(65) Prior Publication Data

US 2023/0371712 A1 Nov. 23, 2023

(30) Foreign Application Priority Data

Sep. 29, 2020 (CN) ..... 202011055970.3

(51) Int. Cl.
*A47D 9/00* (2006.01)

(52) U.S. Cl.
CPC ..... *A47D 9/005* (2013.01)

(58) Field of Classification Search
CPC ..... A47D 9/00; A47D 9/005; A47D 9/008; A47D 9/012; A47D 9/016; A47D 9/02;
(Continued)

(56) References Cited

U.S. PATENT DOCUMENTS 5,778,465 A * 7/1998 Myers ..... A47D 9/005 5/99.1
2002/0092094 A1* 7/2002 Welsh, Jr. ..... A47D 13/063 5/95

(Continued)

FOREIGN PATENT DOCUMENTS

CN 106691008 A 5/2017
CN 207532204 U * 6/2018
CN 210810170 U * 6/2020

OTHER PUBLICATIONS

International Search Report and Written Opinion issued in corresponding International Application No. PCT/EP2021/076779, dated Jan. 18, 2022, pp. 1-14, European Patent Office, Rijswijk, NL.

(Continued)

*Primary Examiner* — George Sun
(74) *Attorney, Agent, or Firm* — HAUPTMAN HAM, LLP

(57) ABSTRACT

A child carrier having a carrier body for carrying a child; a safety belt connected to the carrier body) the safety belt being capable of restraining the child seated in the carrier body; and a buffer assembly connected to the carrier body and the safety belt, the buffer assembly configured to generate a buffering movement responsive to the child carrier being subjected to an impact or sudden deceleration. Responsive to the child carrier being subjected to an impact or sudden deceleration, the buffer assembly connected to the safety belt can generate a buffering movement under the action of inertia, thereby absorbing some of the energy of the impact or sudden deceleration and preventing the safety belt from exerting an excessive restraining and pulling force on the child.

18 Claims, 14 Drawing Sheets

(58) Field of Classification Search
CPC ..... A47D 9/04; A47D 9/053; A47D 9/057; A47D 11/00; A47D 11/005; A47D 11/007
See application file for complete search history.

(56) References Cited

U.S. PATENT DOCUMENTS

| | | | | |
|---|---|---|---|---|
| 2012/0204347 | A1* | 8/2012 | Li | A47D 9/005 5/93.1 |
| 2019/0261783 | A1* | 8/2019 | Mountz | F16B 12/56 |
| 2022/0330715 | A1* | 10/2022 | Tyneski | A47D 9/016 |

OTHER PUBLICATIONS

Office Action in Corresponding European Application No. 21786375.2, dated Apr. 28, 2025; 6 pgs.

* cited by examiner

10

131

CHILD BASSINET

CROSS-REFERENCE TO RELATED APPLICATION(S)

This application claims priority to China patent application no. 202011055970.3 filed on Sep. 29, 2020.

BACKGROUND

Baby bassinets can provide a comfortable and safe environment for a sleeping young child. The child bassinet can typically provide support for the child at an elevated position so that a caregiver can easily reach the child for dispensing care. When the child bassinet is not used, a folding mechanism provided in the child bassinet can be operated to fold the child bassinet to a compact form for storage. In some existing child bassinets, the folding mechanism may not be convenient to operate, e.g., owing to the location or construction of the folding mechanism. Moreover, the support pad at the bottom of the child bassinet generally has to be folded separate from the bassinet frame structure, which does not offer a convenient use.

SUMMARY

The present application describes a child bassinet that can be folded and unfolded in a convenient way and address at least the foregoing issues.

According to one aspect, the child bassinet includes a standing frame including a first leg and a second leg, a top rail portion connected with the standing frame, and a linkage portion coupling the first leg to the second leg at one side of the child bassinet, the linkage portion having an articulation that is movable along the side of the child bassinet to fold and unfold the child bassinet.

DETAILED DESCRIPTION OF THE EMBODIMENTS

Figure 1:
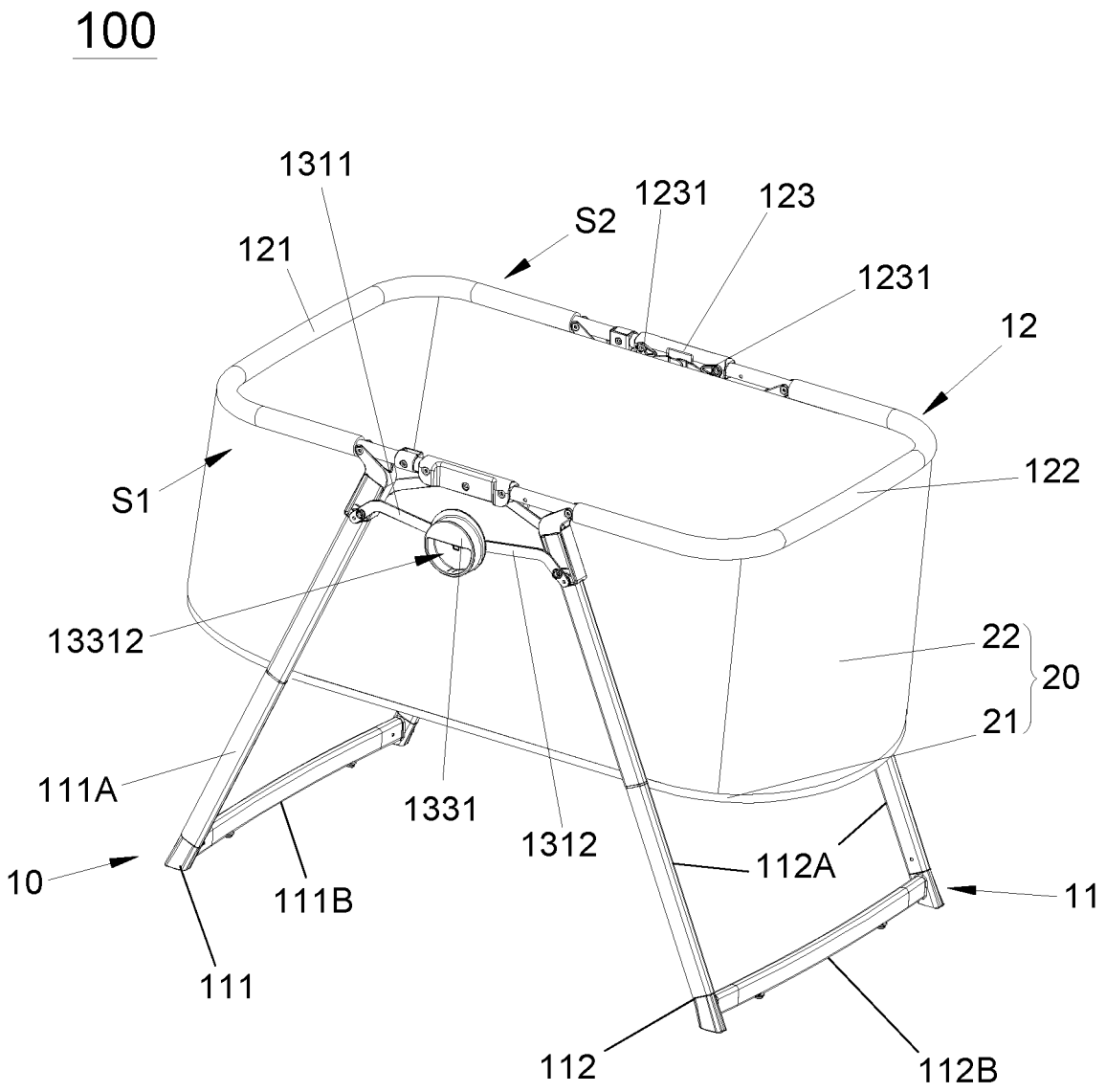
FIG. 1 is a perspective view illustrating an embodiment of a child bassinet.
Figure 2:
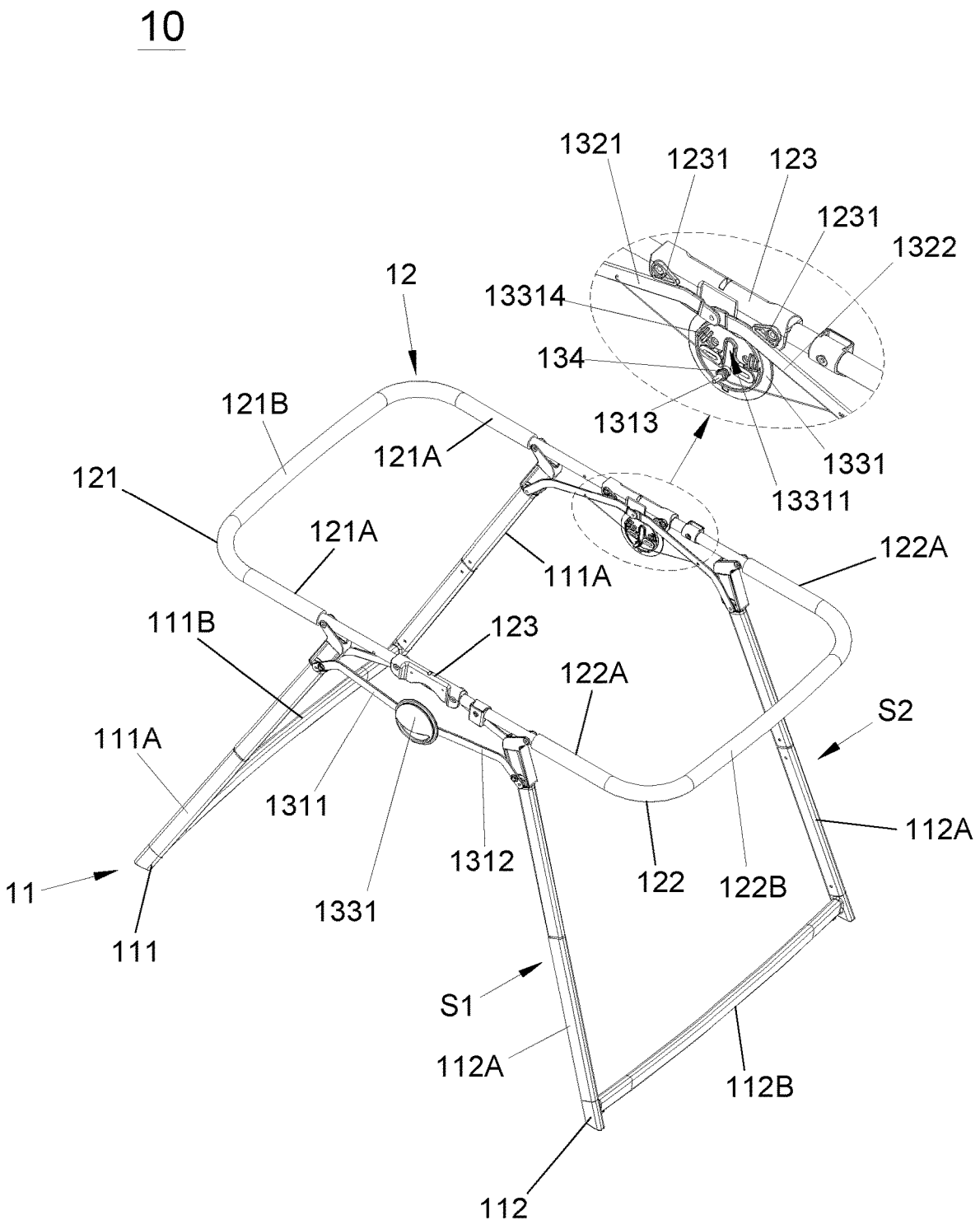
FIG. 2 is a perspective view illustrating a frame structure of the child bassinet shown in FIG. 1.
Figure 3:
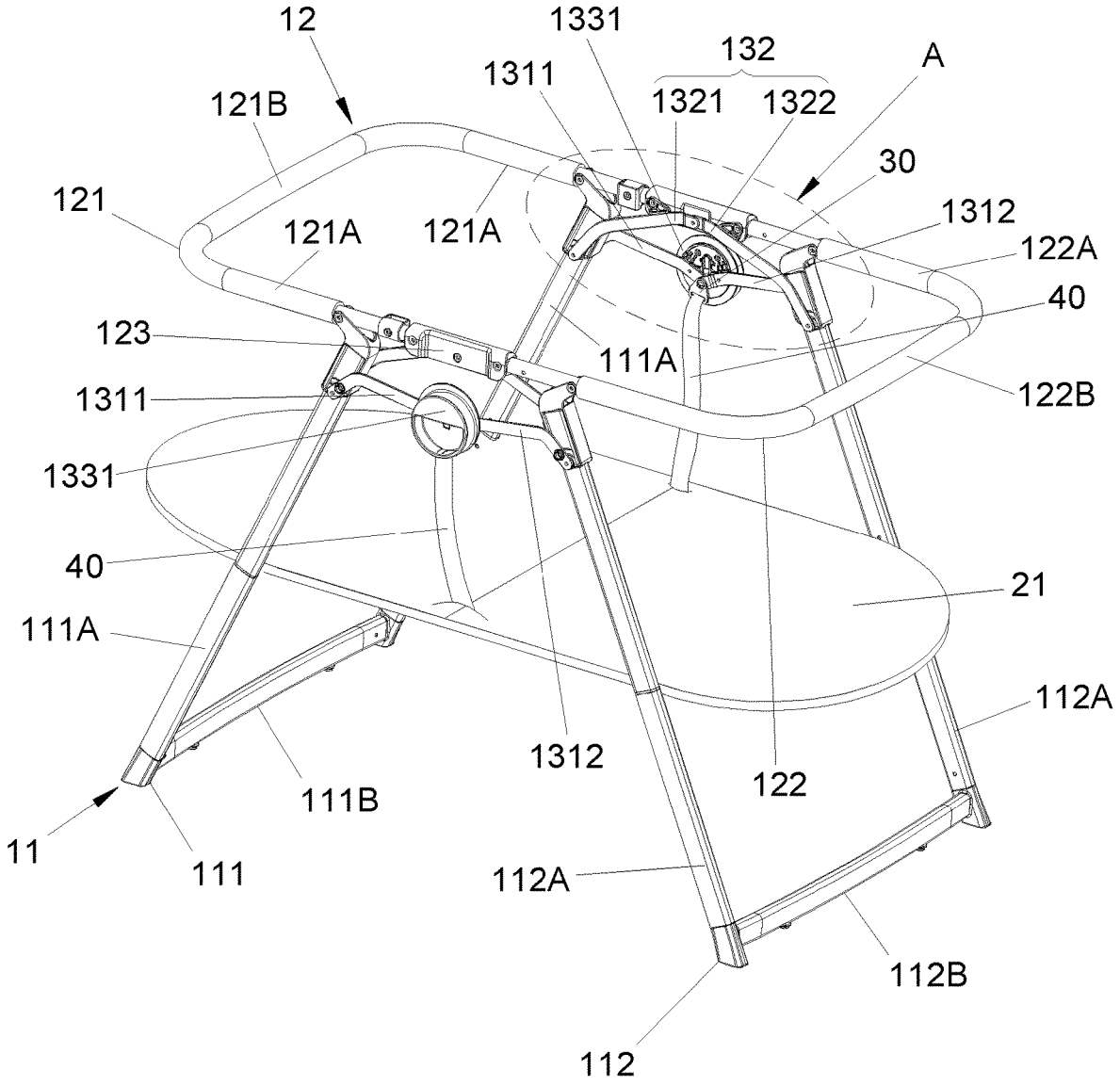
FIG. 3 is a perspective view illustrating the frame structure and a bottom support pad hung therefrom.
Figure 4:
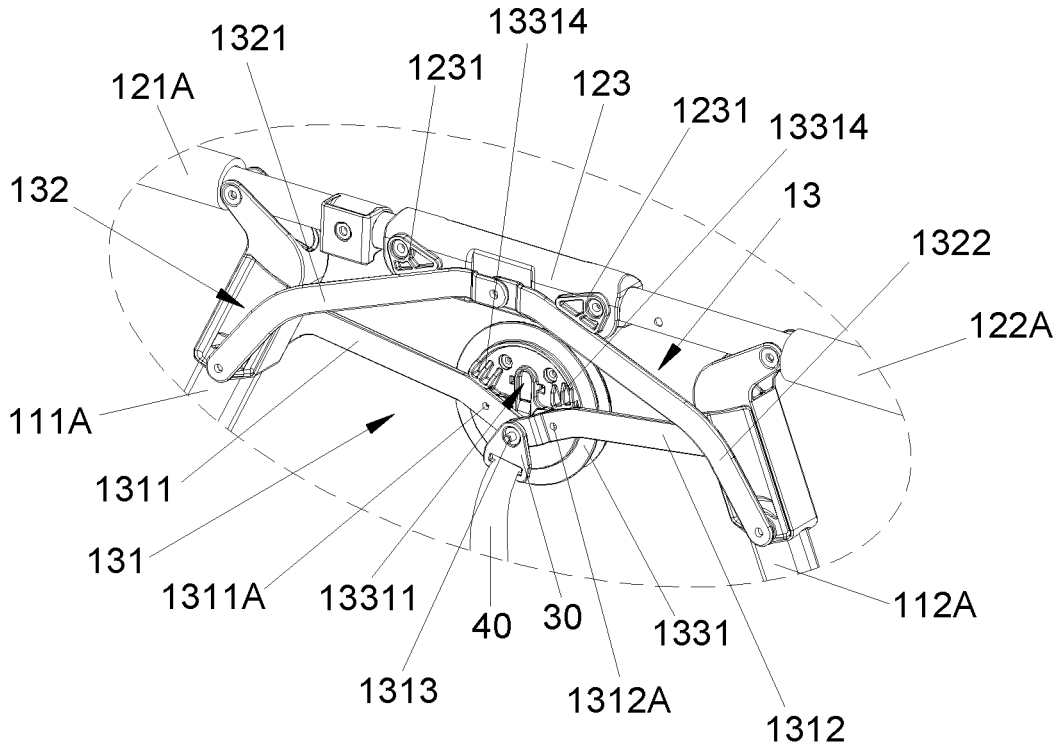
FIG. 4 is an enlarged view of portion A shown in FIG. 3.
Figure 5:
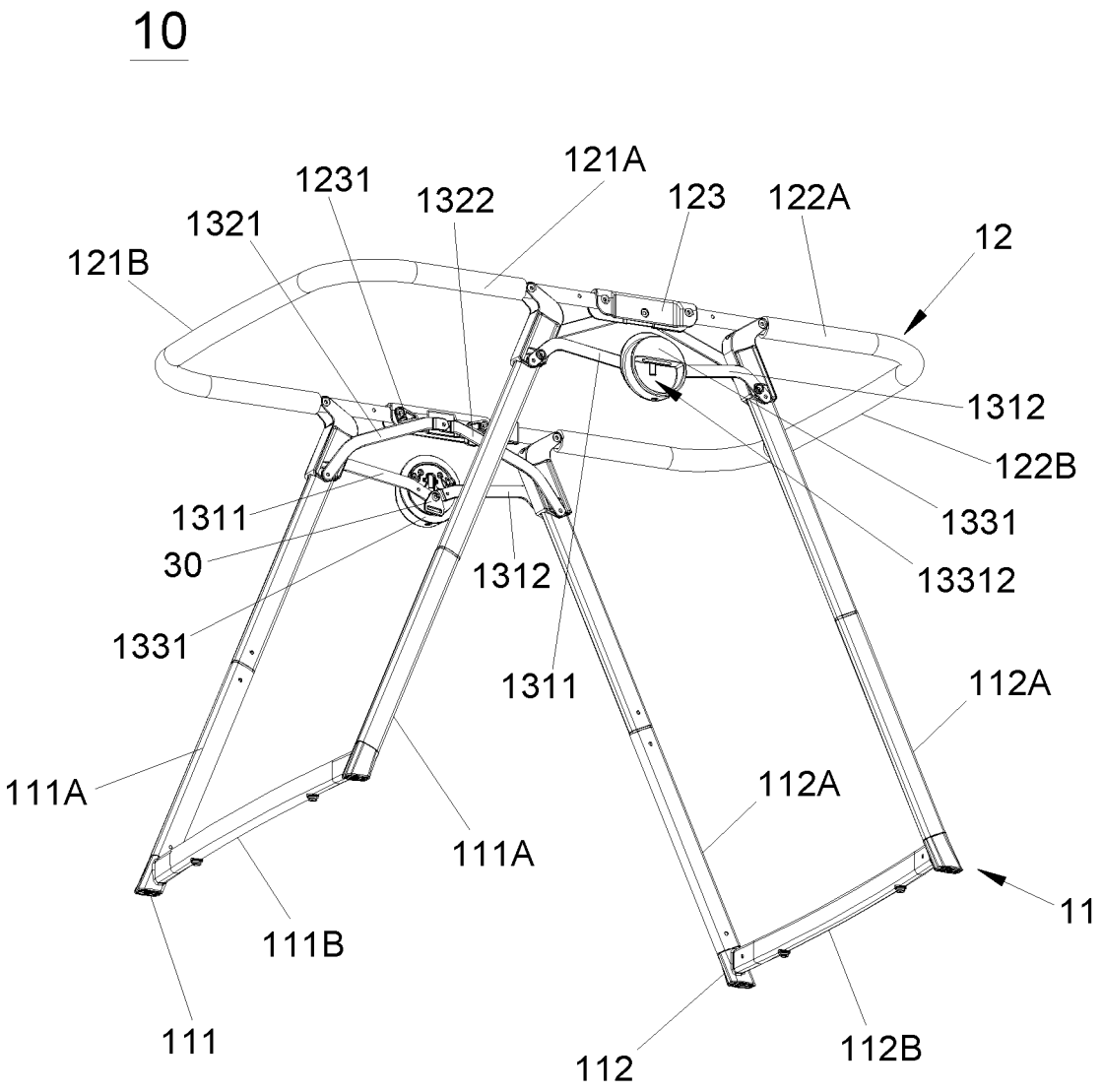
FIG. 5 is another perspective view illustrating the frame structure of the child bassinet shown in FIG. 1.
Figure 6:
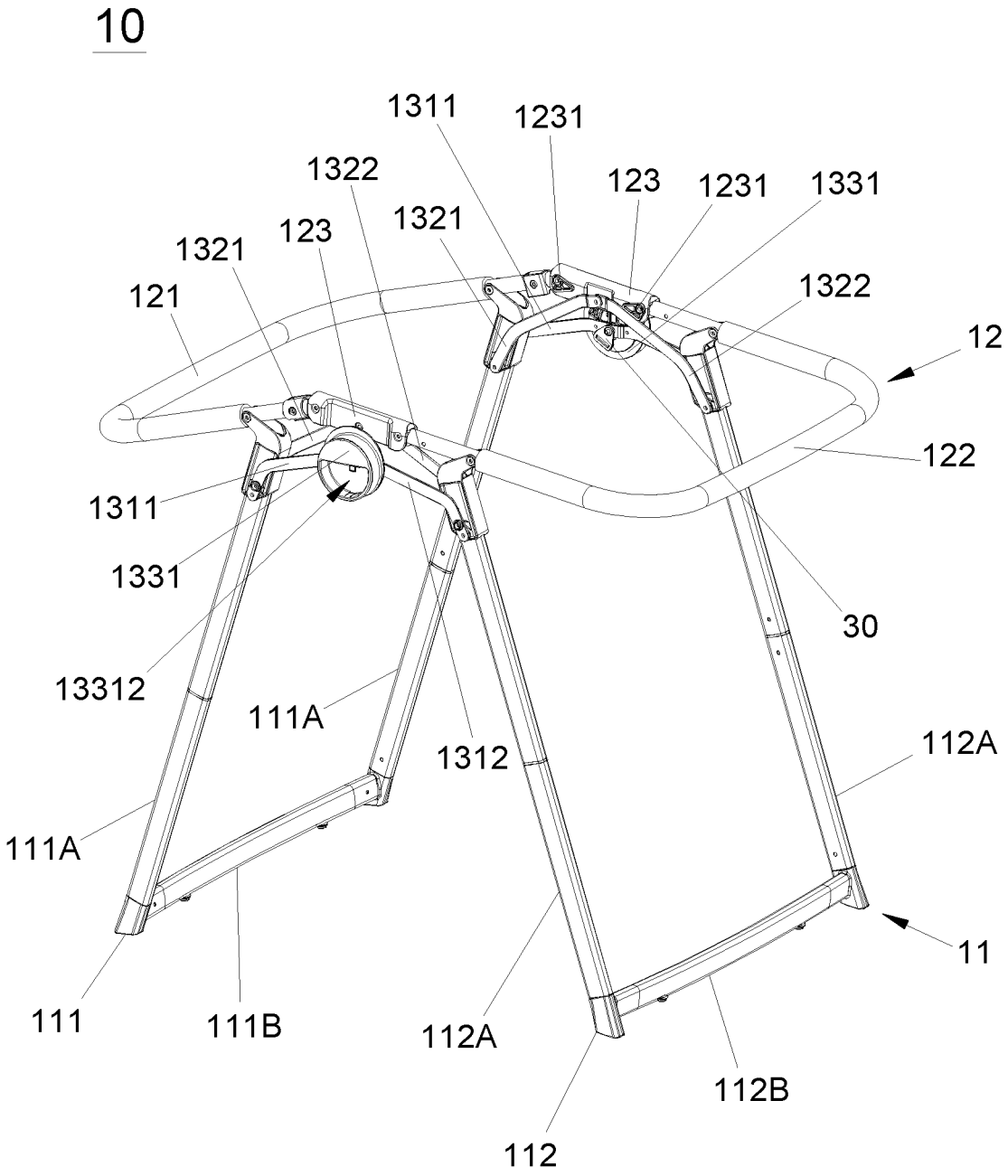
FIG. 6 is a perspective view illustrating the frame structure in a partially folded state.

Referring to FIGS. 1-3, a child bassinet 100 includes a frame structure 10, and an enclosure 20 assembled with the frame structure 10. The frame structure 10 can provide a rigid support to which the enclosure 20 can be attached to delimit at least partially an interior space suitable to receive a child. For example, the enclosure 20 can have a bottom support pad 21 and a sidewall 22. The bottom support pad 21 is adapted to provide support for a child, and may have a foldable structure for convenient use. The sidewall 22 extends around the bottom support pad 21, and may include soft materials such as fabric or mesh materials. The bottom support pad 21 and the sidewall 22 can at least partially define an interior space of the enclosure 20 open upward that is adapted to receive a child.

The frame structure 10 has a foldable construction that can be unfolded for use and folded for storage or transport. The frame structure 10 can include a standing frame 11, and a top rail portion 12 connected with the standing frame 11. The standing frame 11 is adapted to stand on a floor surface. According to an example of construction, the standing frame 11 includes two legs 111 and 112 having a similar structure. For example, the leg 111 can have two side segments 111A respectively provided at two opposite sides S1 and S2 of the child bassinet 100, and a transversal segment 111B fixedly connected with the two side segments 111A. Likewise, the leg 112 can have two side segments 112A respectively provided at the two opposite sides S1 and S2 of the child bassinet 100, and a transversal segment 112B fixedly connected with the two side segments 112A.

The top rail portion 12 can include two rails 121 and 122 having a similar structure that are connected with each other via two articulations 123 at the two opposite sides S1 and S2 of the child bassinet 100. For example, the rail 121 can have two side segments 121A respectively provided at the two opposite sides S1 and S2 of the child bassinet 100, and an end segment 121B fixedly connected with the two side segments 121A that extends between the two opposite sides S1 and S2. Likewise, the rail 122 can have two side segments 122A respectively provided at the two opposite sides S1 and S2 of the child bassinet 100, and an end segment 122B fixedly connected with the two side segments 122A that extends between the two opposite sides S1 and S2. Each of the two articulations 123 can include, without limitation, a housing or a bracket, and can be respectively connected pivotally with one side segment 121A of the rail 121 and one side segment 122A of the rail 122. For example, the two side segments 121A of the rail 121 can be respectively connected pivotally with the two articulations 123 about a first pivot axis, and the two side segments 122A of the rail 122 can be respectively connected pivotally with the two articulations 123 about a second pivot axis spaced apart from the first pivot axis, whereby the rails 121 and 122 are rotatable relative to each other and the two articulations 123 during folding and unfolding of the child bassinet 100.

The top rail portion 12 is pivotally connected with the legs 111 and 112 of the standing frame 11 at top ends of the side segments 111A and 112A. For example, the two side segments 121A of the rail 121 can be respectively connected pivotally with the two side segments 111A of the leg 111 at the top ends thereof, and the two side segments 122A of the rail 122 can be respectively connected pivotally with the two side segments 112A of the leg 112 at the top ends thereof.

Referring to FIGS. 1-4, the frame structure 10 further includes a linkage assembly 13 connected with the standing frame 11 and the top rail portion 12 for facilitating folding and unfolding of the child bassinet 100. At each of the two opposite sides S1 and S2 of the child bassinet 100, the linkage assembly 13 can include a linkage portion 132 that respectively couples the legs 111 and 112 to the articulation 123, and another linkage portion 131 that couples each other the two legs 111 and 112 and has an articulation 1331 that is movable toward and away from the articulation 123 during folding and unfolding of the child bassinet 100.

The linkage portion 132 can include a linking part 1321 that couples the side segment 111A of the leg 111 to the articulation 123, and a linking part 1322 that couples the side segment 112A of the leg 112 to the articulation 123. Each of the linking parts 1321 and 1322 can include, e.g., a rod or bar. The linking part 1321 can have two opposite ends respectively connected pivotally with the side segment 111A of the leg 111 and the articulation 123, and the linking part 1322 can have two opposite ends respectively connected pivotally with the side segment 112A of the leg 112 and the articulation 123.

The linking parts 1321 and 1322 can be exemplarily connected pivotally with the articulation 1223 about a same pivot axis. Through the coupling of the linkage portion 132, the standing frame 11 and the top rail portion 12 can move concurrently during folding and unfolding of the child bassinet 100. When the child bassinet 100 is in an unfolded state, the top rail portion 12 forms a closed shape generally extending horizontally, and the legs 111 and 112 extend downward at an angle from the top rail portion 12. When the child bassinet 100 is in a folded state, the legs 111 and 112 extend substantially parallel to each other, and the top rail portion 12 is folded downward so that the rails 121 and 122 are substantially parallel to each other and extend substantially parallel to the legs 111 and 112.

At each of the two opposite sides S1 and S2 of the child bassinet 10, the linkage portion 131 can include two linking parts 1311 and 1312 that are respectively connected with the articulation 1331 and respectively couple to the side segment 111A of the leg 111 and the side segment 112A of the leg 112. Each of the two linking parts 1311 and 1312 can include, e.g., a rod or bar. The articulation 1331 can include, without limitation, a housing or a bracket. The articulation 1331 can be respectively connected pivotally with the two linking parts 1311 and 1312 about two spaced-apart pivot axes, e.g., at two respective locations 1311A and 1312A on the linking parts 1311 and 1312 as better shown in FIG. 4. The linking part 1311 can have a distal end distant from the articulation 1331 that is pivotally connected with the side segment 111A of the leg 111, and the linking part 1312 can have a distal end distant from the articulation 1331 that is pivotally connected with the side segment 112A of the leg 112. For a compact assembly, each side segment 111A of the leg 111 can be respectively connected pivotally with the corresponding linking parts 1311 and 1321 in a coaxial manner, and each side segment 112A of the leg 112 likewise can be respectively connected pivotally with the corresponding linking parts 1312 and 1322 in a coaxial manner. It will be appreciated, however, that a non-coaxial arrangement may be applied for the pivotal connection between each side segment 111A of the leg 111 and the corresponding linking parts 1311 and 1321, as well as for the pivotal connection between each side segment 112A of the leg 111 and the corresponding linking parts 1312 and 1322. Through the coupling of the linkage portion 131, the legs 111 and 112 can move concurrently during folding and unfolding of the child bassinet 100, the articulation 1331 of the linkage portion 131 moving toward the articulation 123 of the top rail portion 12 during folding operation and away from the articulation 123 of the top rail portion 12 during unfolding operation.

Since the standing frame 11, the top rail portion 12 and the linkage portions 131 and 132 move in a linked manner, lifting the articulation 1331 of the linkage portion 131 along the corresponding side S1 or S2 can cause the child bassinet 100 to fold, and lowering the articulation 1331 of the linkage portion 131 along the corresponding side S1 or S2 can cause the child bassinet 100 to unfold. For example, the articulation 1331 of the linkage portion 131 can be raised to an upper position adjacent to the articulation 123 of the top rail portion 12 to fold the frame structure 10 (better shown in FIG. 7), and can be lowered to a lower position below and spaced apart from the articulation 123 of the top rail portion 12 to unfold the frame structure 10 (as shown in FIG. 3). As better shown in FIGS. 11 and 12, the articulation 1331 of the linkage portion 131 can have an actuating portion 13312 for facilitating manual operation of the articulation 1331. The actuating portion 13312 can have any suitable structure that can be easily grasped with a hand for operation, such as a recessed structure, a handle, or the like. Accordingly, a caregiver can raise and lower the articulation 1331 of the linkage portion 131 by grasping the actuating portion 13312.

Figure 7:
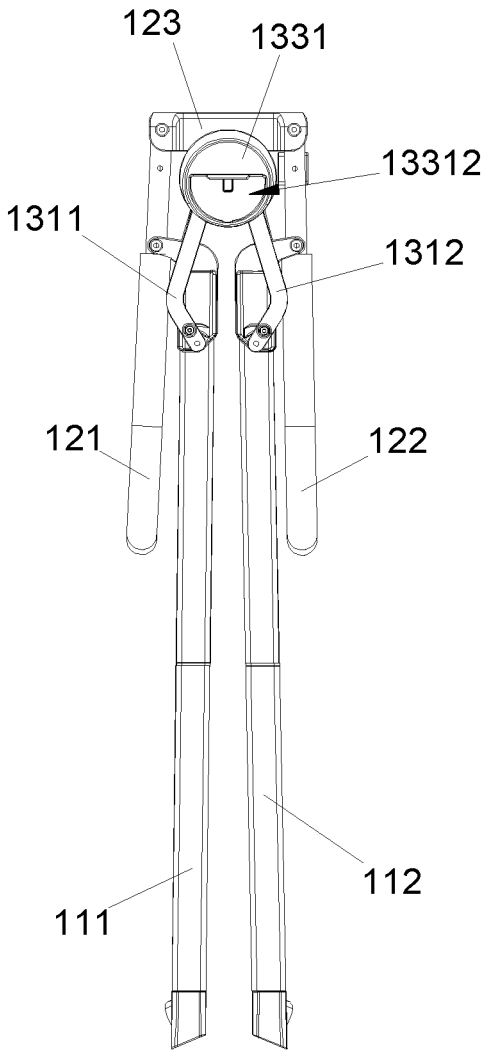
FIG. 7 is a side view illustrating the frame structure in a fully folded state.
Figure 8:
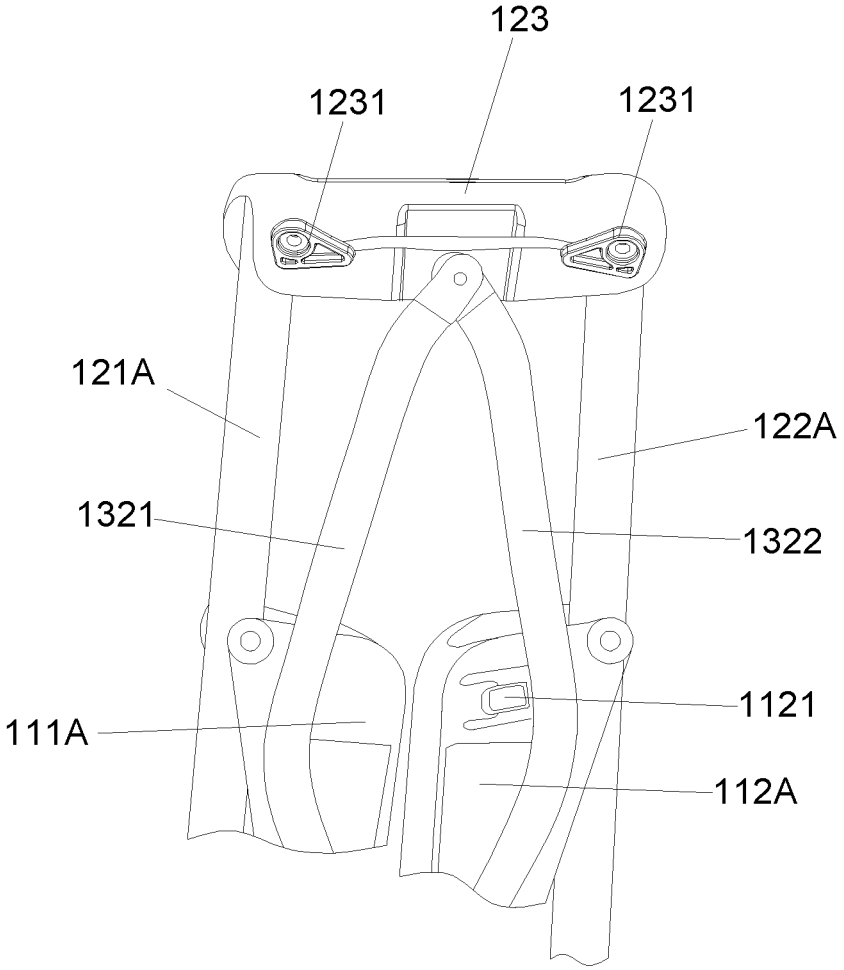
FIG. 8 is a schematic view illustrating a portion of the frame structure in the fully folded state.

When the frame structure 10 is in the unfolded state (as shown in FIG. 3), the two linking parts 1311 and 1312 of the linkage portion 131 can project at two opposite sides of the articulation 1331 and extend generally horizontally between the two legs 111 and 112, and the two linking parts 1321 and 1322 of the linkage portion 132 can extend above the two linking parts 1311 and 1312 and converge on the articulation 123 at an angle. When the frame structure 10 is in the folded state (as shown in FIGS. 7 and 8), the two linking parts 1321 and 1322 of the linkage portion 132 and the two linking parts 1311 and 1312 of the linkage portion 131 can extend generally in a same direction adjacent to one another.

Stop structures may be disposed at various locations to limit the displacements of the movable parts of the linkage assembly 13 during folding and unfolding operation. For example, the articulation 1331 of the linkage portion 131 may have two stop protrusions 13314 (better shown in FIG. 4) that can respectively contact with the two linking parts 1311 and 1312 when the frame structure 10 is in the unfolded state, which can assist in stopping the two linking parts 1311 and 1312 and prevent excessive rotation thereof in the unfolding direction. The articulation 123 of the top rail portion 12 may also include two stop protrusions 1231 (better shown in FIG. 4) that can respectively contact with the two linking parts 1321 and 1322 when the frame structure 10 is in the unfolded state, which can assist in stopping the two linking parts 1321 and 1322 and prevent excessive rotation thereof in the unfolding direction. Further, an upper end portion of the side segment 112A of the leg 112 may also have a stop protrusion 1121 (better shown in FIG. 8) that can contact with an inner edge of the linking part 1322 when the frame structure 10 is in the folded state, which can assist in stopping the linking part 1322 and prevent its excessive rotation in the folding direction. The upper end portion of the side segment 111A may also have a similar stop protrusion 1121 that can contact with an inner edge of the linking part 1321 when the frame structure 10 is in the folded state.

For better stability, the linkage portion 131 may be configured to provide resistance against a folding movement while the frame structure 10 is in the unfolded state. To this purpose, further construction features can be provided in the linkage portion 131 as described hereinafter. Referring to FIGS. 4 and 9-13, each of the two linking parts 1311 and 1312 can have a proximate end adjacent to the articulation 1331 that is commonly connected with a coupling part 1313, which is arranged in a region between the two locations 1311A and 1312A where the articulation 1331 respectively connects pivotally with the two linking parts 1311 and 1312. For example, the coupling part 1313 can include a pin portion disposed through the two linking parts 1311 and 1312 so that each of the two linking parts 1311 and 1312 is slidably and pivotally connected with the coupling part 1313. As the two linking parts 1311 and 1312 respectively rotate relative to the articulation 1331, the coupling part 1313 concurrently slides relative to the articulation 1331. More specifically, the coupling part 1313 can slide upward relative to the articulation 1331 when the two linking parts 1311 and 1312 respectively rotate for folding the linkage portion 131, and can slide downward relative to the articulation 1331 when the two linking parts 1311 and 1312 respectively rotate for unfolding the linkage portion 131. According to an example of construction, the articulation 1331 may have an elongate slot 13311 for guiding the displacement of the coupling part 1313, wherein the coupling part 1313 can lie adjacent to a lower end of the elongate slot 13311 when the frame structure 10 is in the unfolded state. When the frame structure 10 is in the unfolded state, the coupling part 1313 is in an off-axis position offset below a line L (better shown in FIG. 10) that joins the pivot connection between the linking part 1311 and the side segment 111A of the leg 111 to the pivot connection between the linking part 1312 and the side segment 112A of the leg 112. This configuration may provide better stability in the unfolded state. The off-axis position may be set, e.g., by providing at least one bend portion in each of the two linking parts 1311 and 1312.

Figure 9:
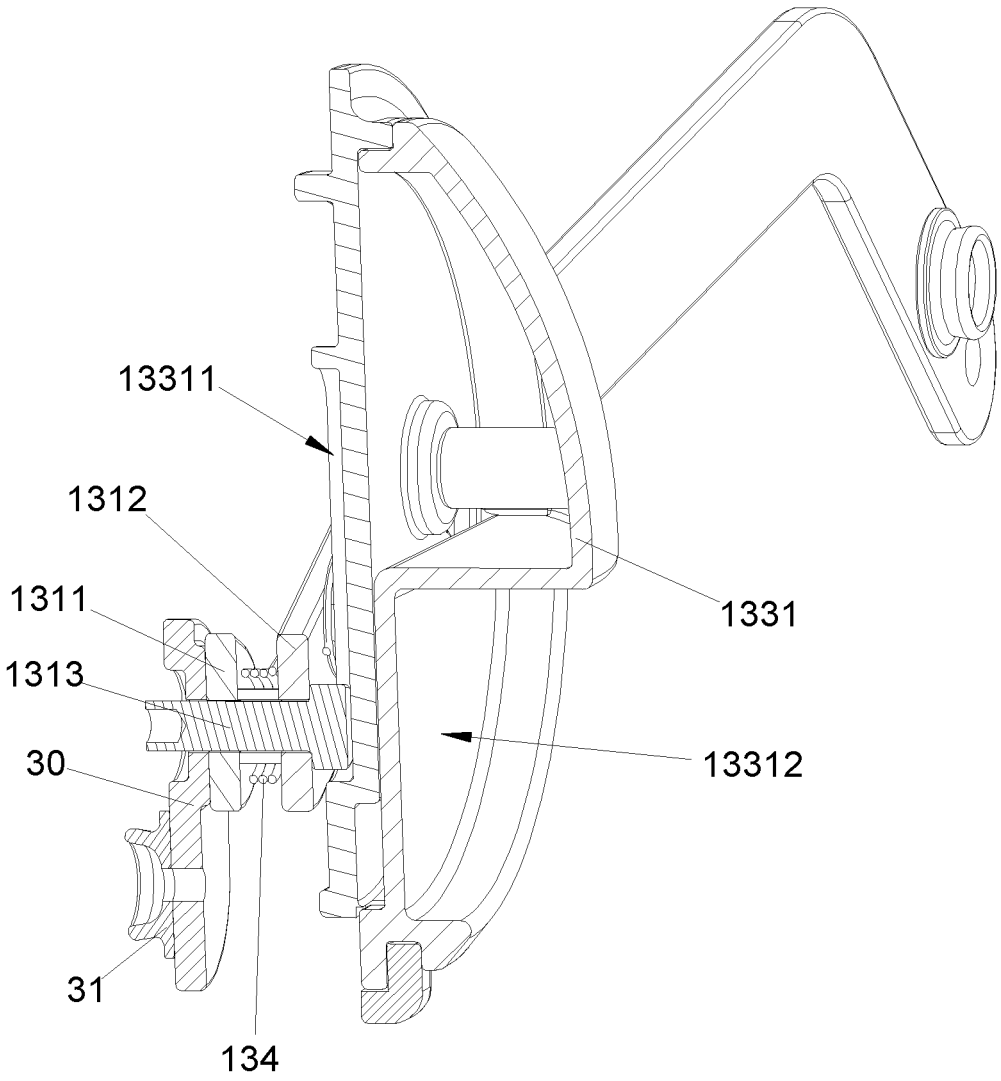
FIG. 9 is a cross-sectional view illustrating some construction details provided in a linkage portion of the frame structure.
Figure 10:
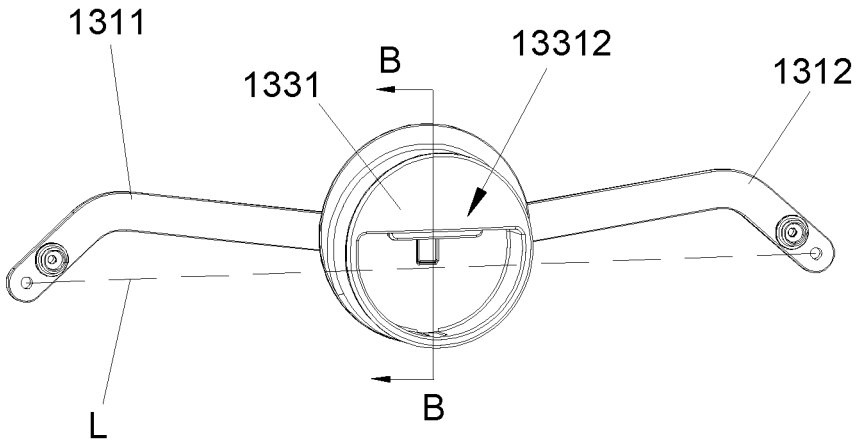
FIG. 10 is a perspective view illustrating the linkage portion shown in FIG. 9.

Referring to FIGS. 2 and 9, the linkage portion 131 can include a resilient part 134 disposed adjacent to the coupling part 1313 that is adapted to assist in keeping the coupling part 1313 in the off-axis position when the frame structure 10 is in the unfolded state. For example, the resilient part 134 can be a torsion spring that is disposed around the coupling part 1313 between the two linking parts 1311 and 1312 and has two ends respectively connected with the two linking parts 1311 and 1312.

When the frame structure 10 is in the unfolded state, the resilient part 134 is in a first configuration where the biasing force of the resilient part 134 tends to displace the coupling part 1313 downward below the line L toward the off-axis position, which can assist in keeping the frame structure 10 in the unfolded state. This first configuration can correspond to an arrangement where the coupling part 1313 is lower than the two locations where the two ends of the resilient part 134 respectively connect with the two linking parts 1311 and 1312. While the frame structure 10 is folding, the coupling part 1313 slides upward, and the resilient part 134 can transition from the first configuration to a second configuration where the biasing force of the resilient part 134 tends to displace the coupling part 1313 upward for facilitating folding of the frame structure 10. The second configuration can correspond to an arrangement where the coupling part 1313 is higher than the two locations where the two ends of the resilient part 134 respectively connect with the two linking parts 1311 and 1312.

Referring to FIGS. 1-12, the frame structure 10 can further include a locking mechanism 133 operable to lock the linkage portion 131 for holding the child bassinet 100 in the unfolded state and to unlock the linkage portion 131 for folding of the child bassinet 100. More specifically, the locking mechanism 133 can be carried with the articulation 1331, and can include a latch 1332, a spring 1334 and a release actuator 1333.

Figure 11:
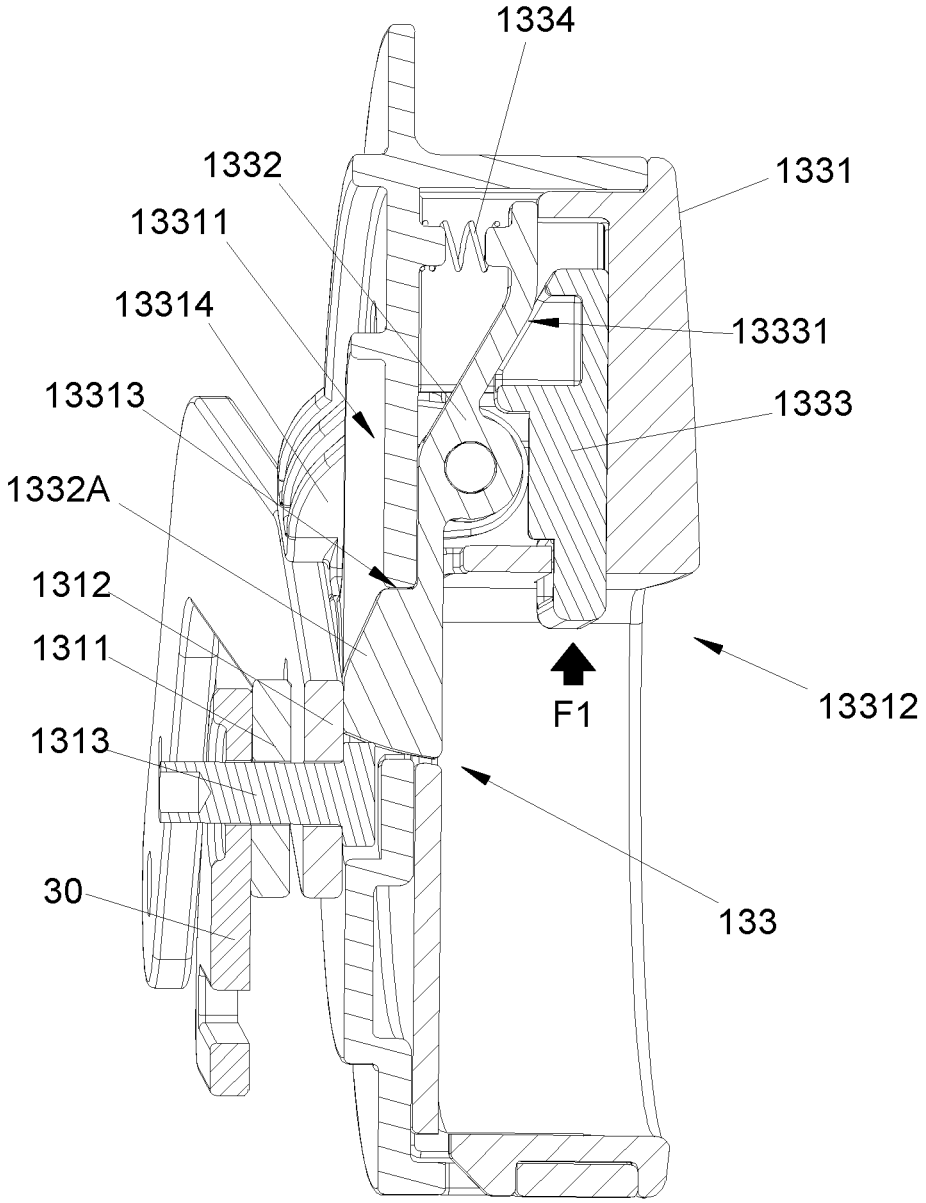
FIG. 11 is a cross-sectional view along section B-B shown in FIG. 10 illustrating construction details of a locking mechanism provided in the linkage portion.
Figure 12:
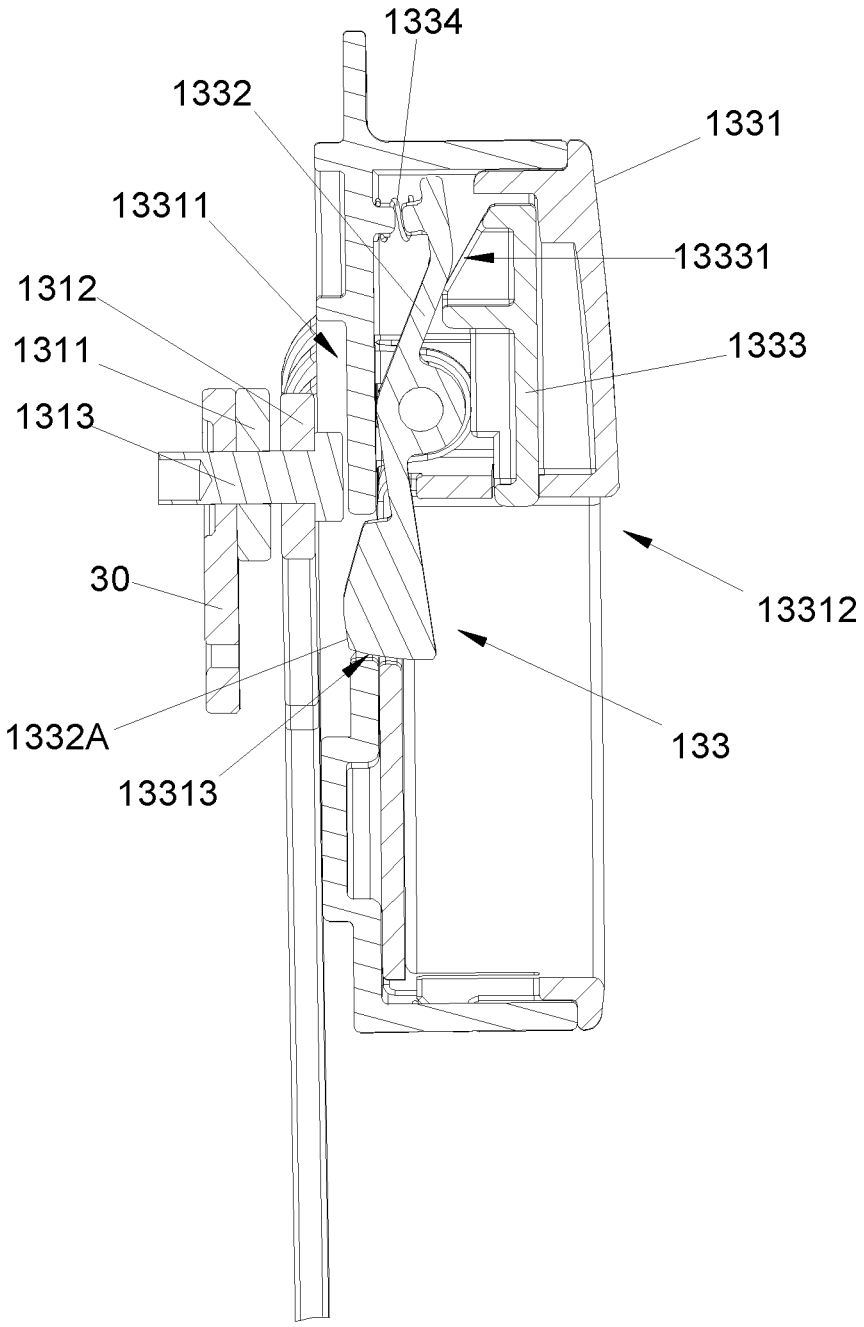
FIG. 12 is a cross-sectional view illustrating the locking mechanism shown in FIG. 11 in an unlocking state.
Figure 13:
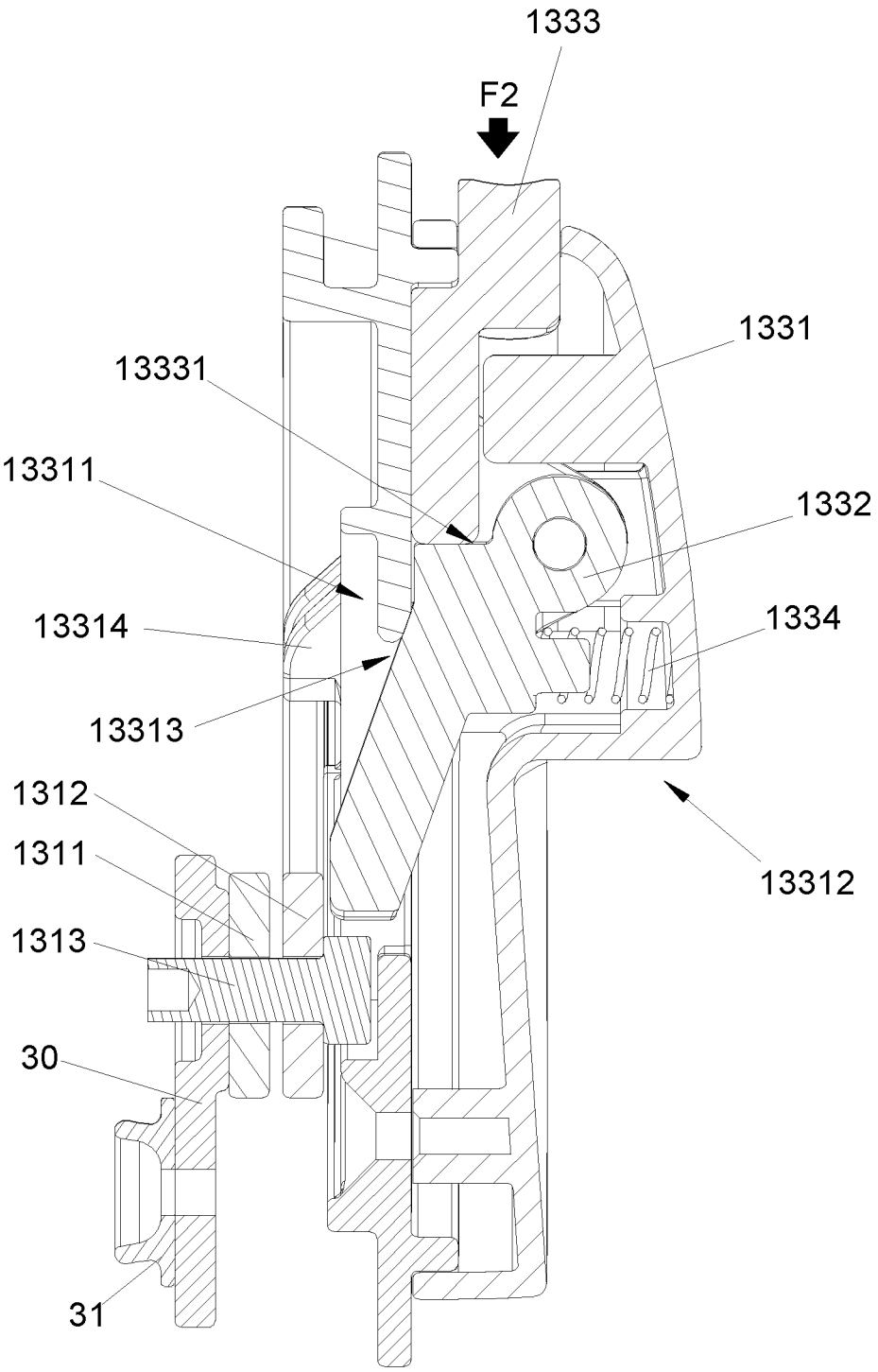
FIG. 13 is a cross-sectional view illustrating a variant construction of the locking mechanism provided in the linkage portion shown in FIG. 10.
Figure 14:
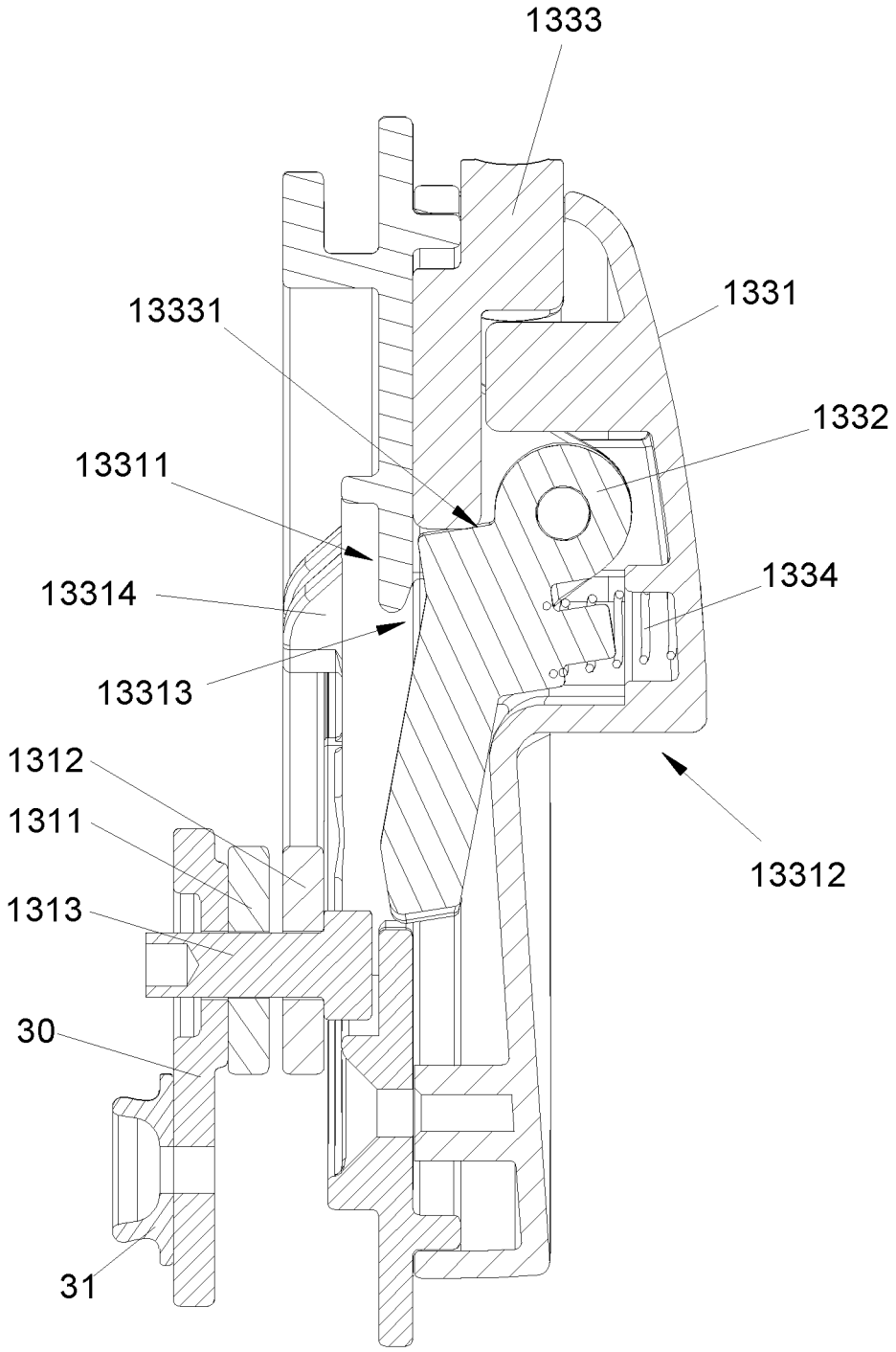
FIG. 14 is a cross-sectional view illustrating the locking mechanism shown in FIG. 13 in an unlocking state.

Referring to FIGS. 11 and 12, the latch 1332 is movably connected with the articulation 1331, e.g., via a pivotal connection. It will be appreciated, however, that the latch 1332 can be connected with the articulation 1331 via other movable connections, such as sliding connections. The latch 1332 is movable relative to the articulation 1331 between a locking position where the latch 1332 locks the linking parts 1311 and 1312 with respect to the articulation 1331 in the unfolded state, and an unlocking position where the latch 1332 unlocks the linking parts 1311 and 1312 so that the linking parts 1311 and 1312 are respectively rotatable relative to the articulation 1331 and the linkage portion 131 can move for folding the child bassinet 100. For example, the latch 1332 can engage with the coupling part 1313 in the locking position so that the coupling part 1313 is prevented from sliding upward relative to the articulation 1331, which blocks folding rotation of the linking parts 1311 and 1312 relative to the articulation 1331 and thereby locks the linkage portion 131 in the unfolded state. In the unlocking position, the latch 1332 is disengaged from the coupling part 1313 so that the coupling part 1313 can slide upward relative to the articulation 1331, thereby allowing rotation of the linking parts 1311 and 1312 relative to the articulation 1331 for folding the linkage portion 131. According to an example of construction, the articulation 1331 can have an opening 13313 in a bottom surface of the elongate slot 13311, and the latch 1332 can have an engaging end 1332A that protrudes outward through the opening 13313 in the locking position and retract inward in the unlocking position. While the latch 1332 is in the unlocking position, the coupling part 1313 can slide upward past the engaging end 1332A of the latch 1332 as the frame structure 10 is folded.

The spring 1334 is respectively connected with the articulation 1331 and the latch 1332, and can bias the latch 1332 toward the locking position. For example, the latch 1332 can be pivotally connected with the articulation 1331, and the spring 1334 can urge the latch 1332 to rotate relative to the articulation 1331 toward the locking position.

The release actuator 1333 is movably connected with the articulation 1331, e.g., via a sliding connection. It will be appreciated, however, that the release actuator 1333 can be connected with the articulation 1331 via other movable connections, such as pivotal connections. The release actuator 1333 is operable to urge the latch 1332 to move from the locking position to the unlocking position. For example, the release actuator 1333 is movable relative to the articulation 1331 to urge the latch 1332 to move from the locking position to the unlocking position via a sliding contact between a driving portion 13331 of the release actuator 1333 and the latch 1332, wherein one or both of the latch 1332 and the driving portion 13331 of the release actuator 1333 can have a bevel at which the sliding contact can be effected. For facilitating manual operation, the release actuator 1333 can be disposed adjacent to the actuating portion 13312 of the articulation 1331 so that a caregiver can grasp the actuating portion 13312 and operate the release actuator 1333 with a same hand. In the example shown in FIGS. 11 and 12, the locking mechanism 133 is configured so that the release actuator 1333 is slidable in an upward direction F1 relative to the articulation 1331 to urge the latch 1332 to move from the locking position to the unlocking position.

In conjunction with FIGS. 11 and 12, FIGS. 13 and 14 are cross-sectional views illustrating a variant construction of the locking mechanism 133 in which the release actuator 1333 is still disposed adjacent to the actuating portion 13312 of the articulation 1331 but at another location different from that shown in FIGS. 11 and 12. In the example shown in FIGS. 13 and 14, the locking mechanism 133 is configured so that the release actuator 1333 is slidable downward relative to the articulation 1331 to urge the latch 1332 to move from the locking position to the unlocking position. Accordingly, a caregiver has to press the release actuator 1333 in a downward direction F2 to unlock and then raise the articulation 1331 for folding the child bassinet 100. Because this arrangement requires two operating steps in opposite directions, accidental folding of the child bassinet 100 may be prevented.

Referring to FIGS. 1-4 and 9, the enclosure 20 may be attached to the frame structure 10 so as to hang above a floor surface. For example, the sidewall 22 of the enclosure 20 can have an upper end coupled to the top rail portion 12, the linkage portions 131 and 132 being adjacent to the sidewall 22 at each of the two opposite sides S1 and S2 of the child bassinet 100. The bottom support pad 21 can be coupled to the frame structure 10 via a plurality of hangers 40, whereby the bottom support pad 21 can be hung at an elevated position above a floor surface. The hangers 40 can include, without limitations, flexible bands, straps, cords, ropes, or the like. According to an example of construction, the hangers 40 may be respectively attached to the linkage portions 131 so that folding and unfolding of the frame structure 10 can concurrently displace the bottom support pad 21 and cause its folding and unfolding. For example, a connector 30 can be disposed adjacent to the articulation 1331 of each linkage portion 131, and a corresponding one of the hangers 40 can have two opposite ends respectively coupled to the connector 30 and the bottom support pad 21. The connector 30 can move upward and downward along with the articulation 1331 of the linkage portion 131. In this manner, raising the articulation 1331 of each linkage portion 131 can draw the corresponding hanger 40 upward and cause the bottom support pad 21 to fold, and lowering the articulation 1331 of each linkage portion 131 can cause the bottom support pad 21 to unfold. According to an example of construction, the connector 30 can have a hole through which the coupling part 1313 of the linkage portion 131 engages for attaching the connector 30 to the coupling part 1313. According to another example of construction, the connector 30 may be directly attached to the articulation 1331 of the linkage portion 131.

Referring to FIGS. 1 and 9, the connector 30 may further be configurable to detachably connect with the sidewall 22 of the enclosure 20. For example, the connector 30 may have a fastening portion 31 adapted to engage with and disengage from a fastener (not shown) provided on the sidewall 22 of the enclosure 20. According to an example of construction, the fastening portion 31 can be configured to engage with a snap fastener provided on the sidewall 22 of the enclosure 20. It will be appreciated, however, that other fastening structures may be suitable to attach the sidewall 22 of the enclosure 20 with the connector 30, which may include, without limitations, buckle fasteners, strap and/or lace fasteners, hook and loop fasteners, or the like.

Exemplary operation for folding the child bassinet 100 is described hereinafter with reference to FIGS. 1-14. For folding the child bassinet 100, a caregiver first operates the release actuator 1333 (e.g., by pressing the release actuator 1333 in the direction F1 in the example of FIG. 11 or in the direction F2 in the example of FIG. 13) so as to unlock the linkage portion 131 at each of the two opposite sides S1 and S2. Then the articulation 1331 of the linkage portion 131 is raised along the corresponding side S1 or S2, which causes the legs 111 and 112 of the standing frame 11 and the rails 121 and 122 of the top rail portion 12 to fold in a concurrent manner. As the articulation 1331 of the linkage portion 131 moves upward for folding the frame structure 10, the corresponding hanger 40 is drawn upward to concurrently fold the bottom support pad 21.

Advantages of the child bassinet described herein include the ability to provide a frame structure that allows convenient folding and unfolding. The child bassinet can be folded and unfolded by raising and lowering an articulation of a linkage portion along each of two opposite sides of the child bassinet, which can offer better accessibility for manual operation.

Realization of the child bassinet has been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A child bassinet comprising:

a standing frame including a first leg and a second leg;

a top rail portion connected with the standing frame; and a linkage portion coupling the first leg to the second leg at one side of the child bassinet, the linkage portion having a first articulation that is movable along the side of the child bassinet to fold and unfold the child bassinet, wherein the linkage portion includes a first linking part respectively connected pivotally with the first articulation and the first leg, and a second linking part respectively connected pivotally with the first articulation and the second leg, and the first linking part and the second linking part are commonly connected with a coupling part that is arranged in a region between two locations where the first articulation respectively connects pivotally with the first linking part and the second linking part, the coupling part being slidable relative to the first articulation as the first linking part and the second linking part respectively rotate relative to the first articulation.

2. The child bassinet according to claim 1, wherein each of the first linking part and the second linking part is slidably and pivotally connected with the coupling part.

3. The child bassinet according to claim 1, wherein the coupling part is in an off-axis position offset below a line that joins a pivot connection between the first linking part and the first leg to a pivot connection between the second linking part and the second leg, when the child bassinet is in an unfolded state.

4. The child bassinet according to claim 3, wherein the linkage portion includes a resilient part disposed adjacent to the coupling part, the resilient part being adapted to assist in keeping the coupling part in the off-axis position when the child bassinet is in the unfolded state.

5. The child bassinet according to claim 3, wherein the linkage portion includes a resilient part disposed adjacent to the coupling part, the resilient part being operable during a folding movement of the linkage portion to transition from a first configuration where a biasing force of the resilient part assists in keeping the coupling part in the off-axis position to a second configuration where the biasing force of the resilient part tends to displace the coupling part in a direction that facilitates folding of the child bassinet.

6. The child bassinet according to claim 4, wherein the resilient part is a torsion spring disposed around the coupling part that has two ends respectively connected with the first linking part and the second linking part.

7. The child bassinet according to claim 1, further comprising a locking mechanism operable to lock the linkage portion for holding the child bassinet in an unfolded state and to unlock the linkage portion for folding of the child bassinet.

8. The child bassinet according to claim 7, wherein the locking mechanism is carried with the first articulation.

9. The child bassinet according to claim 7, wherein the locking mechanism includes a latch connected with the first articulation, the latch being movable relative to the first articulation between a locking position where the latch locks the first and second linking parts with respect to the first articulation in the unfolded state, and an unlocking position where the latch unlocks the first and second linking parts so that the first and second linking parts are respectively rotatable relative to the first articulation.

10. The child bassinet according to claim 9, wherein the locking mechanism further includes a release actuator connected with the first articulation, the release actuator being operable to urge the latch to move from the locking position to the unlocking position.

11. The child bassinet according to claim 10, wherein the first articulation has an actuating portion adapted to be grasped with a hand, and the release actuator is disposed adjacent to the actuating portion of the first articulation.

12. The child bassinet according to claim 9, wherein the latch is engaged with the coupling part in the locking position and disengaged from the coupling part in the unlocking position.

13. The child bassinet according to claim 1, further comprising a second linkage portion that respectively couples the first and second legs to the second articulation.

14. The child bassinet according to claim 13, wherein the second linkage portion includes a third linking part respectively connected pivotally with the second articulation and the first leg, and a fourth linking part respectively connected pivotally with the second articulation and the second leg.

15. The child bassinet according to claim 1, further comprising an enclosure having a bottom support pad adapted to provide support for a child, and a hanger attached to the linkage portion and coupled to the bottom support pad.

16. The child bassinet according to claim 15, wherein the hanger has two opposite ends respectively coupled to the bottom support pad and a connector disposed adjacent to the first articulation of the linkage portion.

17. The child bassinet according to claim 16, wherein the connector is attached to the coupling part.

18. The child bassinet according to claim 1, wherein the top rail portion includes a first rail and a second rail that are respectively connected pivotally with a second articulation at the same side of the child bassinet where the linkage portion couples the first leg to the second leg, the first rail being connected pivotally with the first leg, and the second rail being connected pivotally with the second leg.

* * * * *